US006224449B1

(12) United States Patent
Niimi et al.

(10) Patent No.: US 6,224,449 B1
(45) Date of Patent: May 1, 2001

(54) METHOD OF FORMING LEAD-IN SEAL IN HIGH PRESSURE DISCHARGE LAMPS

(75) Inventors: Norikazu Niimi, Komaki; Michio Asai, Nagoya, both of (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 09/517,045

(22) Filed: Mar. 2, 2000

Related U.S. Application Data

(62) Division of application No. 08/825,350, filed on Mar. 28, 1997, now Pat. No. 6,057,644.

(30) Foreign Application Priority Data

May 16, 1996 (JP) ..... 8-121490
Mar. 18, 1997 (JP) ..... 9-64048

(51) Int. Cl.[7] ..... H01J 9/32
(52) U.S. Cl. ..... 445/26
(58) Field of Search ..... 445/26

(56) References Cited

U.S. PATENT DOCUMENTS

| | | | |
|---|---|---|---|
| 4,376,906 | | 3/1983 | Szilagyi et al. . |
| 4,501,799 | | 2/1985 | Driessen et al. . |
| 4,891,553 | | 1/1990 | Bamberg et al. . |
| 4,892,498 | | 1/1990 | Gradl et al. . |
| 4,950,953 | | 8/1990 | Ito et al. . |
| 5,279,909 | * | 1/1994 | Horner et al. ..... 429/184 |
| 5,404,078 | | 4/1995 | Bunk et al. . |
| 5,532,552 | | 7/1996 | Heider et al. . |
| 5,552,670 | | 9/1996 | Heider et al. . |
| 5,592,049 | | 1/1997 | Heider et al. . |
| 5,742,123 | | 4/1998 | Nagayma . |

FOREIGN PATENT DOCUMENTS

| | | |
|---|---|---|
| 2065299 | 4/1973 | (DE) . |
| 4242122 | 6/1994 | (DE) . |
| 0327049 | 8/1989 | (EP) . |
| 1022432 | 3/1966 | (GB) . |
| 6-318435 | 11/1994 | (JP) . |
| 07-21990 | 1/1995 | (JP) . |

* cited by examiner

*Primary Examiner*—Kenneth J. Ramsey
(74) *Attorney, Agent, or Firm*—Parkhurst & Wendel, L.L.P.

(57) ABSTRACT

A high pressure discharge lamp comprising a ceramic discharge tube having an inner space filled with an ionizable light-emitting material and a starting gas, plugging members each at least partially fixed to an inner side of respective one of end portions of the ceramic discharge tube and each having a through-hole provided therein, conductive members inserted into or through the through-holes of the plugging members, respectively, and electrode units provided in said inner space, wherein a material of the plugging members is the same as that of the ceramic discharge tube, and each of the plugging members is gas-tightly joined to the corresponding conductive member with a metallizing layer.

4 Claims, 10 Drawing Sheets

METHOD OF FORMING LEAD-IN SEAL IN HIGH PRESSURE DISCHARGE LAMPS

This is a Division of application Ser. No. 08/825,350 filed Mar. 28, 1997, now U.S. Pat. No. 6,057,644.

BACKGROUND OF THE INVENTION

1. Field of the Invention

The present invention relates to high pressure discharge lamps using ceramic discharge tubes and processes for the production thereof.

2. Related Art Technique

In the above high pressure discharge lamp, a plugging members (ordinarily called ceramic plugs) are inserted into both end portions of the ceramic discharge tube to close these end portions, a through-hole is provided in each of the plugging members, and a metallic current conductor having a given electrode system fixed thereto is inserted into the through-hole. An ionizable light-emitting material is sealed in an inner space of the ceramic discharge tube. As such a high pressure discharge lamp, a high pressure sodium light-emitting lamp, a metal halide lamp, etc. are known. In particular, the metal halide lamp has a good color rendering property. Use of ceramics as materials for discharge tubes has made it possible to use such high pressure discharge lamps at high temperatures.

In such a discharge lamp, it is necessary to effect gas-tight sealing between the end portions of the ceramic discharge tube and respective electrode unit-holding members. A main portion of the ceramic discharge tube takes a tubular shape or a barrel shape of which both end portions are reduced in size or a straight cylindrical shape. The ceramic discharge tube is made of, for example, a sintered alumina body. In order to seal the end portions of the ceramic discharge tube, for example, JP-A-6 318435 discloses the following structure. That is, plugging members are inserted into interiors of end portions of the ceramic discharge tube, and held there. A through-hole is formed in each of the plugging members in an axial direction thereof, and a slender electrode unit-holding member is fixedly inserted into the through-hole. The plugging member is made of a cermet containing both alumina and a metal constituting the electrode unit-holding member at such a given ratio that the coefficient of thermal expansion of the plugging member may fall between the coefficient of thermal expansion of the electrode unit-holding member and that of the ceramic discharge tube.

In the formation of the above sealed structure, it is designed that the inner diameter of each end portion of the ceramic discharge tube becomes slightly smaller than the outer diameter of the plugging member if the ceramic discharge tube is fired in such a state that a preform of the plugging member is not inserted into a preform of the ceramic discharge tube. Consequently, the plugging member is firmly radially inwardly tightened and held inside the end portion of the ceramic discharge tube. This is the same as to the plugging member and the electrode unit-holding member.

However, the present inventors have further advanced investigations upon such sealed structures, and discovered that they had the following problems. That is, the plugging member and the electrode unit-holding member are sealed based on a pressure between them. However, since the discharge lamp repeatedly undergoes a number of cycles between turning on and turning off, it is necessary that reliability of the sealed portion is further enhanced judging from the difference in thermal expansion. In particular, in case of the metal halide having high corrosive property, a sealed structure having high corrosion resistance and high reliability needs to be developed.

SUMMARY OF THE INVENTION

It is an object of the present invention to provide a novel sealed structure for a high pressure discharge lamp, which sealed structure-has high corrosion resistance and high reliability against the metal halide without substantially imparting thermal stress between a plugging member and a ceramic discharge tube.

The high pressure discharge lamp according to the present invention has a ceramic discharge tube having an inner space filled with an ionizable light-emitting material and a starting gas, plugging members each at least partially fixed to an inner side of a respective one of the end portions of the ceramic discharge tube and each having a through-hole provided therein, conductive members inserted into or through the through-holes of the plugging members, respectively, and electrode units provided in said inner space, wherein a material of the plugging members is the same as that of the ceramic discharge tube, and each of the plugging members is gas-tightly joined to the corresponding conductive member with a metallizing layer.

Further, the present invention is directed to the process for production of the above high pressure discharge lamp, which process includes the steps of: inserting the conductive members into or through through-holes of non-fired preforms of the respective plugging members; providing metallizing layers between the through-holes of the non-fired preforms and the respective conductive members; and then integrally firing the non-fired preforms, the metallizing layers, and the conductive members.

The high pressure discharge lamp according to another aspect of the present invention includes a ceramic discharge tube having an inner space filled with an ionizable light-emitting material and a staring gas, conductive members inserted into or through through-holes of the ceramic discharge tube at end portions, respectively, and electrode units provided in said inner space, wherein the end portions of the ceramic discharge tube and each of the conductive members is gas-tightly joined together with a metallizing layer.

The present invention is also directed to a process for the production of the above high pressure discharge lamp, which process is characterized by comprising the steps of: inserting the conductive members into or through through-holes of a non-fired preform of the ceramic discharge tube; providing layers of a metallizing material between the through-holes of the non-fired preform and surfaces of the respective conductive members; and then integrally firing the non-fired preform, the metallizing material, and the conductive members.

The present inventors thought of a technical idea that the material of the plugging members fixed to the end portions of the ceramic discharge tube is the same as that of the ceramic discharge tube and that the plugging members are gas-tightly joined to the respective conductive members with the metallizing layers. They discovered through their experiments that extremely high gas-tightness was held between the plugging members and the respective conductive members, and that the high pressure discharge lamp still kept high reliability even when it repeatedly underwent a number of cycles between turning on and turning out. The inventors reached the present invention based on the above discovery.

The present inventors further discovered that when the conductive member was directly and gas-tightly sealed to the inner side of the end portion of the ceramic discharge tube via the metallizing layer, extremely high gas-tightness was maintained between the plugging member and the conductive member, and that the high pressure discharge lamp still kept high reliability even when it repeatedly underwent a number of cycles between turning on and turning out. Owing to this, an extremely large merit is industrially obtained, since the plugging members can be omitted, and the number of the constituent parts decreases, and the production steps can be largely simplified.

In addition, this technique is extremely effective in making the high pressure discharge lamp compact. That is, the width dimension of the high pressure discharge lamp is limited by the dimension of the end portion thereof. However, since the plugging member was inserted into or through the inner side of the end portion of the ceramic discharge tube, it was difficult to make the dimension of the ceramic discharge tube smaller in the width direction than a certain limit, and consequently it was difficult to make the volume of the inner space of the ceramic discharge tube smaller than a given level. As a result, when the output was concretely suppressed to a level of not more than 25 W, the light-emitting efficiency inside the space of the ceramic discharge tube largely lowered. According to the present invention, since the ceramic discharge tube can be made compact unlike the above, the invention is epoch-making in that a high pressure discharge lamp having a small output level of not more than 25 W can be offered as a commercial product.

The function and the effects of the present invention will be supplemented. There is ordinarily a considerable difference in thermal expansion between ceramics to be used for the light-emitting tubes or the plugging members and the conductive members, and this difference in thermal expansion may be a cause for leakage through the lamp being subjected to repeated cycles between turning on and turning off. In this respect, according to the structure of the present invention, unlike the conventional technique, joining is effected not only by the press fitting but also chemically with the metallizing layer. Furthermore, since this metallizing layer is not a completely rigid material, it functions to mitigate thermal strain occurring at the joined interface. In addition, since the metallizing layer has excellent corrosion resistance against a halogen based gas or the like, it gives a highly sealing effect and high durability.

These and other objects, features and advantages of the present invention will be appreciated upon reading the following description of the invention when taken in conjunction with the attached drawings, with the understanding that some modifications, variations and changes of the same could be made by the skilled in the art to which the invention pertains.

BRIEF DESCRIPTION OF THE DRAWINGS

For a better understanding of the invention, reference is made to the attached drawings, wherein.

DETAILED DESCRIPTION OF THE INVENTION

Figure 1:
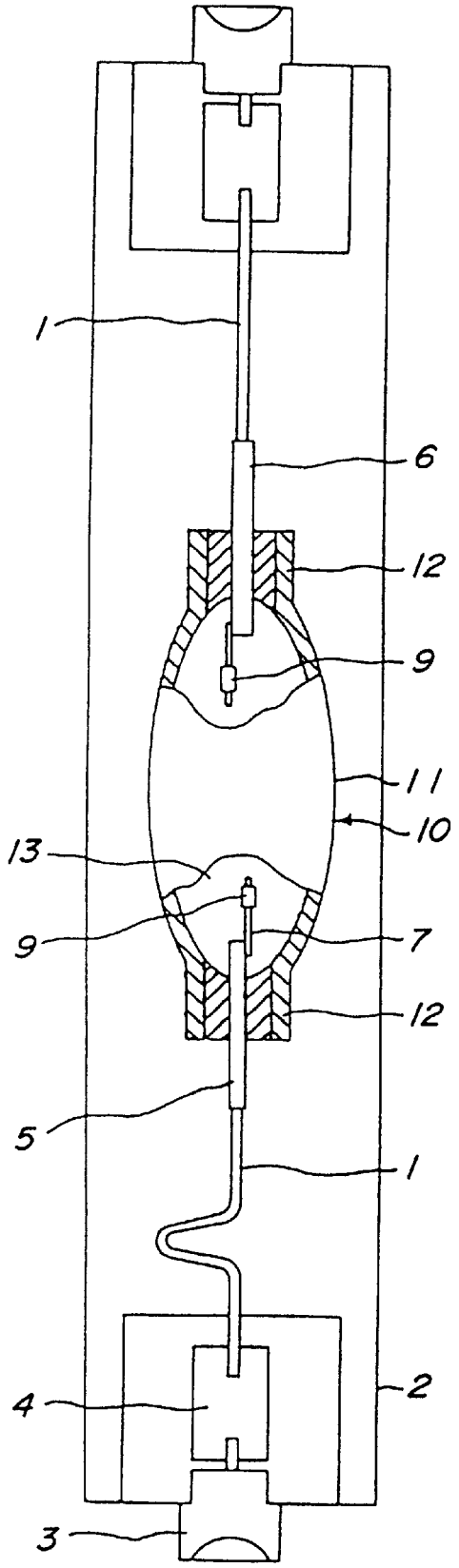
FIG. 1 is a plane view schematically showing an embodiment of the entire structure of the high pressure discharge lamp.

The present invention will be explained more in detail below.

The conductive member may be an electrode unit-holding member to which an electrode unit is directly attached or a tubular member into or through which such an electrode unit-holding member having the electrode unit directly attached thereto is to be inserted. No particular limitation is posed upon the conductive member. As the latter case, a technique described in JP-A 6-318435 may be recited.

As the material for the conductive member, a variety of high melting point metals and conductive ceramics may be used. From the standpoint of conductivity, metals having high melting points are preferred. As such high melting point metals, one or more kinds of metals selected from the group consisting of molybdenum, tungsten, rhenium, niobium, tantalum and their alloys is preferred.

Among them, it is known that although niobium and tantalum have coefficients of thermal expansion almost meeting those of ceramics constituting the ceramic discharge tubes, particularly that of alumina ceramic, niobium and tantalum are likely to be corroded with the metal halide. Therefore, in order to prolong the service life of the conductive member, it is preferable to form the conductive member from a metal selected from the group consisting of molybdenum, tungsten, rhenium and their alloys. However, the metals having high corrosive resistance against the metal halide generally have small coefficients of thermal expansion. For example, the coefficient of thermal expansion of the alumina ceramics is $8\times10^{-6}K^{-1}$, and that of molybdenum is not more than $6\times10^{-6}K^{-1}$.

When molybdenum is used as the material of the conductive member, it is particularly preferable that at least one kind of $La_2O_3$ and $CeO_2$ is contained in molybdenum in a total amount of 0.1 wt % to 2.0 wt %.

As the metal constituting the metallizing layer, one or more kinds of metals selected from the group consisting of molybdenum, tungsten, rhenium, niobium, tantalum and their alloys are preferred. Particularly, in order to improve the corrosion resistance of the metallizing layer against the halogen, metals selected from the group consisting of molybdenum, tungsten, rhenium, niobium, tantalum and their alloys are preferred.

In the metallizing layer, a ceramic component maybe incorporated. As the ceramic component, ceramics having corrosion resistance against the ionizable light-emitting material are preferred. More specifically, one or more kinds of ceramics selected from the group consisting of $Al_2O_3$, $SiO_2$, $Y_2O_3$, $Dy_2O_3$ and $B_2O_3$ are preferred. Particularly, the same kind of ceramics as the material of the ceramic discharge tube are preferable, and alumina ceramics are particularly preferred.

The content ratio between the metallic component and the ceramic component in the metallizing layer is preferably 30/70 vol. % to 70/30 vol. %. The thickness of the metallizing layer is preferably 10 to 200 $\mu$m.

It is particularly preferable that the metallic component constituting the metallizing layer is composed mainly of a metal selected from the group consisting of molybdenum, tungsten, rhenium and their alloys, and the ceramic component is composed mainly of one or more kinds of ceramics selected from alumina, yttria, mullite and silica, and that the ratio between both the components is 30/70 to 70/30 vol. %. Further, if not more than 20 vol. % of metallic silicon is added into the metallizing material before firing, silicon reacts with oxygen in moisture of a firing atmosphere so that the silicon is bound to the metallic component in the metallizing layer via this oxygen to enhance gas-tightness of the metallizing tissue.

In order to form the metallizing layer in the present invention, a layer of the metallizing material is provided or interposed between the through-hole of a non-fired body of the plugging member or a non-fired body of the ceramic discharge tube and the conductive member. The metallizing material is intended to mean a material which forms a metallizing layer after firing. More specifically, the metallizing material may include the above mentioned metallic components and ceramic components.

A layer of the metallizing material may be formed or provided preferably according to any of the following processes.

(1) A metallizing paste is coated and printed on an inner peripheral surface of the through hole of the non-fired body of the plugging member or an inner peripheral surface of the through-hole of the non-fired body of the ceramic discharge tube. Alternatively, the metallizing paste is applied and printed on an outer peripheral surface of the conductive member.

It is preferable to add a binder having high thermal decomposability to the metallizing material constituting the metallizing layer. As such a binder, ethyl cellulose and acrylic binder may be recited.

(2) A cylindrical molded body of the metallizing material is inserted and interposed between any one of the above non-fired bodies and the conductive member. Since this cylindrical molded body needs to have structural strength sufficient to withstand handling, the cylindrical molded body is preferably produced by press molding.

In order to produce the above cylindrical molded body, a binder is added to the metallic component and any necessary ceramic component of the above metallizing layer. The binder is preferably a binder that is likely to be thermally decomposed and easily pressed. As the binder, polyvinyl alcohol (PVA) and acrylic binder are preferred. The binder and a given amount of a solvent are added to the above component(s) for the metallization, and the mixture is granulated by using a spray drier, thereby producing granules. Alternatively, the binder and some solvent are added to the above component(s) for the metallization, and the mixture is subjected to kneading, drying and grinding, thereby producing granules. A cylindrical molded body is obtained by press molding the granules under pressure of 2 to 3 tons/cm$^2$. When the cylindrical molded body is to be fitted between any one of the above non-fired bodies and the conductive member, the cylindrical molded body is fitted around the conductive member, and the non-fired body is fitted around the outer periphery of the molded body. The firing condition is the same as that of the metallizing paste.

(3) A sheet-shaped molded body made of the metallizing natural is interposed between the above non-fired body and the conductive member.

In order to produce the above sheet-shaped molded body, a binder such as an acrylic binder or ethyl cellulose is added to the metallic component and any necessary ceramic component of the metallizing layer, and the sheet-shaped molded body is obtained with use of a solvent such as butylcarbitol acetate (BCA), for example, according to the doctor blade process.

As the material for the plugging member, the same material as that of the ceramic discharge tube is used. By so doing, almost no residual stress acting toward a central axis of the ceramic discharge tube occurs. The material here means a material having common a ceramic as a base material, although additive(s) may differ.

If the conductive member is made of a metal, the metallic component in the metallizing layer is preferably the same as the conductive member. In this case, the joining force between the conductive member and the metallizing layer is enhanced.

The above-mentioned sealing method may be employed in both end portions of the ceramic discharge tube. Since the ionizable light-emitting material needs to be poured into the discharge tube through the conductive member at one end portion, the conductive member needs to be tubular. In the other end portion, conductive members having a rod-shaped form, a tubular-shaped form, or other various forms may be used.

The ceramic discharge tube may generally take a tubular form, a cylindrical form, a barrel form or the like. If the electrode unit-holding member is tubular and the ionizable light-emitting material is sealingly charged in the discharge tube through the electrode unit-holding member, the electrode unit-holding member is sealed by laser welding or TIG welding after the above sealed charging.

FIG. 1 is a plane view for schematically showing one embodiment of the entire structure of the high pressure discharge tube. A ceramic discharge tube 10 is placed in an outer tube 2 made of quartz glass or hard glass, and the center axis of the outer tube is accurately aligned with that of the ceramic discharge tube 10. Both ends of the outer tube 2 are gas-tightly sealed with respective caps 3. The ceramic discharge tube 10 includes a barrel-shaped main body 11 having a swelled central portion and end portions 1 at both ends of the main body 11, respectively. The ceramic discharge tube 10 is held by the outer tube 2 via two lead wires 1. Each lead wire 1 is connected to the cap 3 via a foil 4. The upper lead wire 1 is welded to a tubular or rod-shaped electrode unit-holding member 6, while the lower lead wire 1 is welded to the tubular electrode unit-holding member 5.

Each of the electrode unit-holding members 5, 6 is fixedly inserted through a through-hole in a plugging member. To each of the electrode unit-holding members 5, 6 is gas-tightly connected an electrode shaft 7 inside the main body 11 by welding, and a coil is wound around the electrode shaft 7, thereby constituting an electrode unit. The shape of the electrode unit is not particularly limited, and for example, a terminal portion of the electrode shaft 7 may take a spherical form that may be used as an electrode. A sealing structure of the end portions of the discharge tube will be described later. In the case of a metal halide high pressure discharge lamp, an inert gas such as argon and a metal halide are sealingly charged into an inner space 13 of the ceramic discharge tube 10, and mercury is also sealingly charged therein if necessary.

Figure 2A:
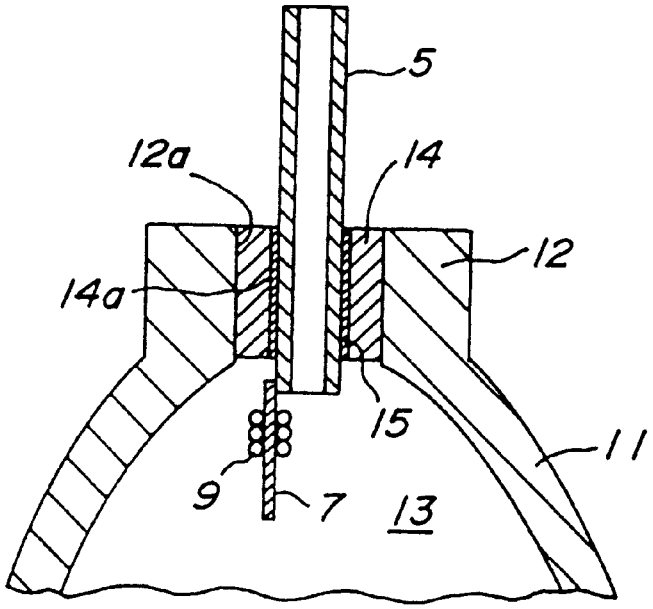
FIGS. 2(*a*) and 2(*b*) are sectional views for showing, in an enlarged scale, surrounding areas around end portions of ceramic discharge tubes according to further embodiments of the present invention, respectively.
Figure 2B:
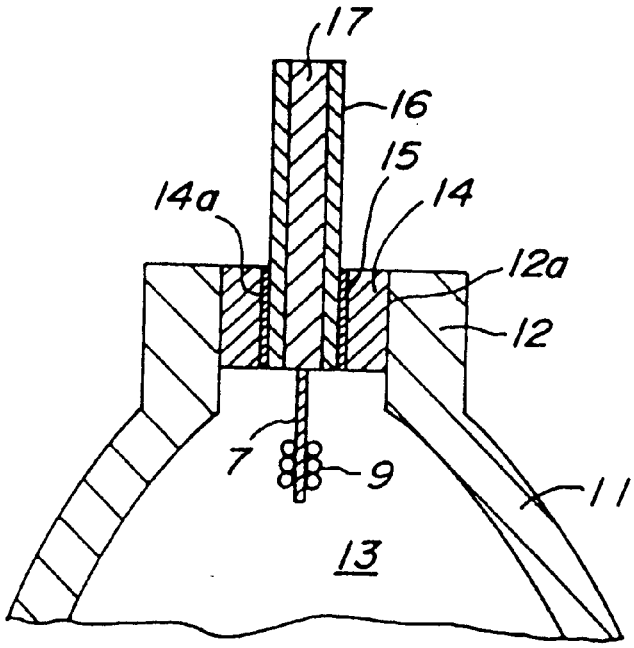

FIGS. 2(*a*) and 2(*b*) are sectional views for showing, in an enlarged scale, surrounding areas of end portions as in the ceramic discharge tube, respectively. In FIG. 2(*a*), a main body 11 of the ceramic discharge tube has a curved inner face, and an inner face 12*a* of an end portion 12 is straight as viewed in a direction of the central axis of the ceramic discharge tube. Inside the end portion 12 of the discharge tube is inserted a plugging member 14. The discharge tube 11 and the plugging member 14 are made of the same ceramics, preferably alumina ceramics, and an interface between the discharge tube 11 and the plugging member 14 almost disappears during a firing step.

A slender tubular electrode unit-holding member 5 is inserted through a through-hole 14*a* of the plugging member 14. At a terminal end at an outer side of the electrode unit-holding member 5 is provided an opening which is to be sealed after the starting gas and the ionizable light-emitting material are sealingly charged. Sealing is effected between the plugging member 14 and the electrode unit-holding member 5 with a metallizing layer 15.

In FIG. 2(*b*), a conductive member 16 has a tubular shape, and an electrode unit-holding member 17 to which an electrode unit is directly attached is inserted into the interior of the tubular member 16. This attaching method is disclosed in JP-A 6 318435. More specifically, the tubular member 16 is welded to the electrode unit-holding member 17 at their outer end portions.

Figure 3A:
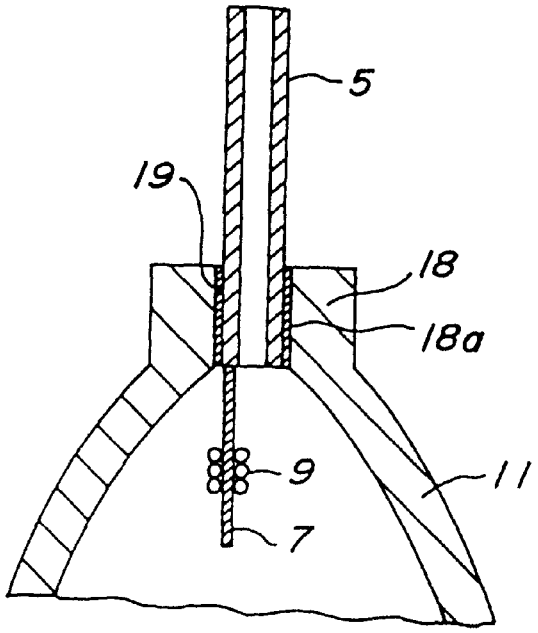
FIGS. 3(*a*) and 3(*b*) are sectional views for showing, in an enlarged scale, surrounding areas around end portions of ceramic discharge tubes according to still further embodiments of the present invention, respectively.
Figure 3B:
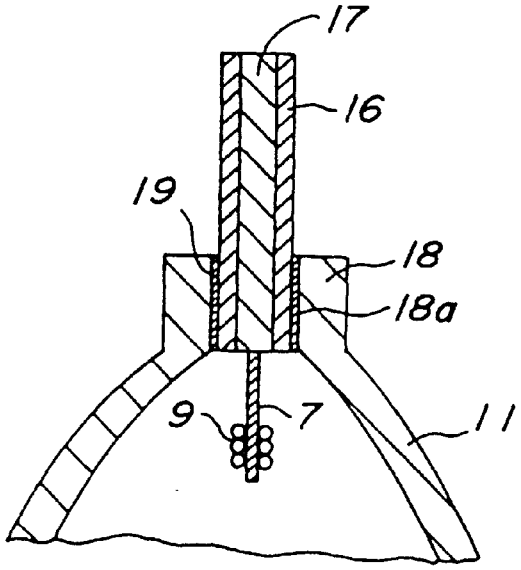

As shown in FIG. 3(*a*), an electrode unit-holding member 5 is inserted into the interior of an end portion 18 of a ceramic discharge tube 11, and sealing is effected between the electrode unit-holding member 5 and the inner peripheral surface 18*a* of the end portion 18 with a metallizing layer 19. In FIG. 3(*b*), an electrode unit-holding member 17 is inserted into the interior of the tubular member 16, and sealing is effected between the tubular member 16 and the inner peripheral face of the end portion 18 with the metallizing layer 19.

Figure 4A:
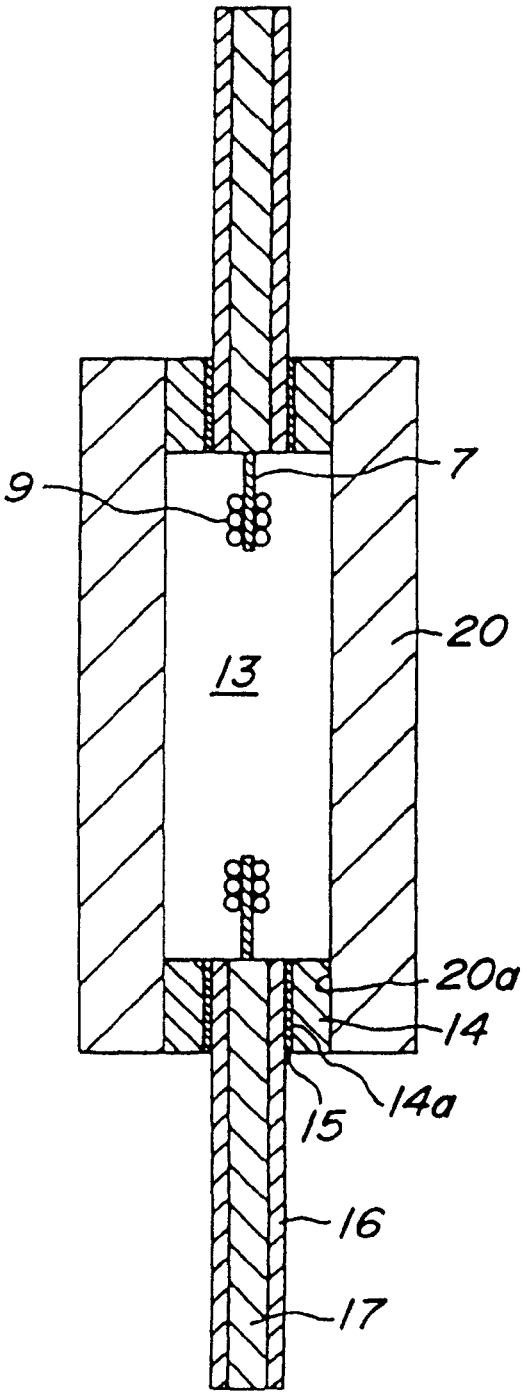
FIGS. 4(*a*) and 4(*b*) are sectional views for schematically showing high pressure discharge lamps as preferable embodiments of the present invention, respectively.
Figure 4B:
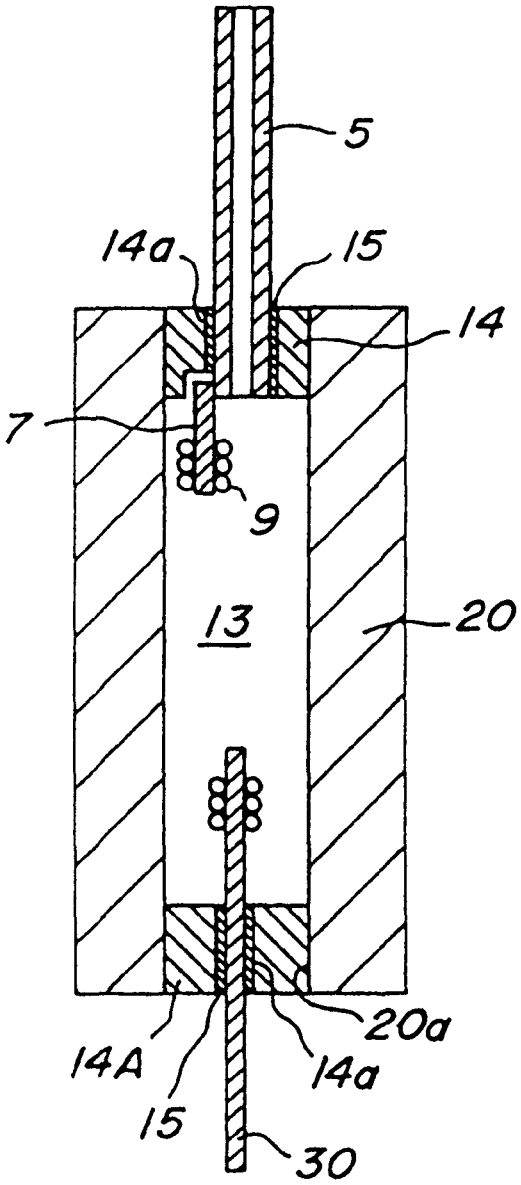
Figure 5A:
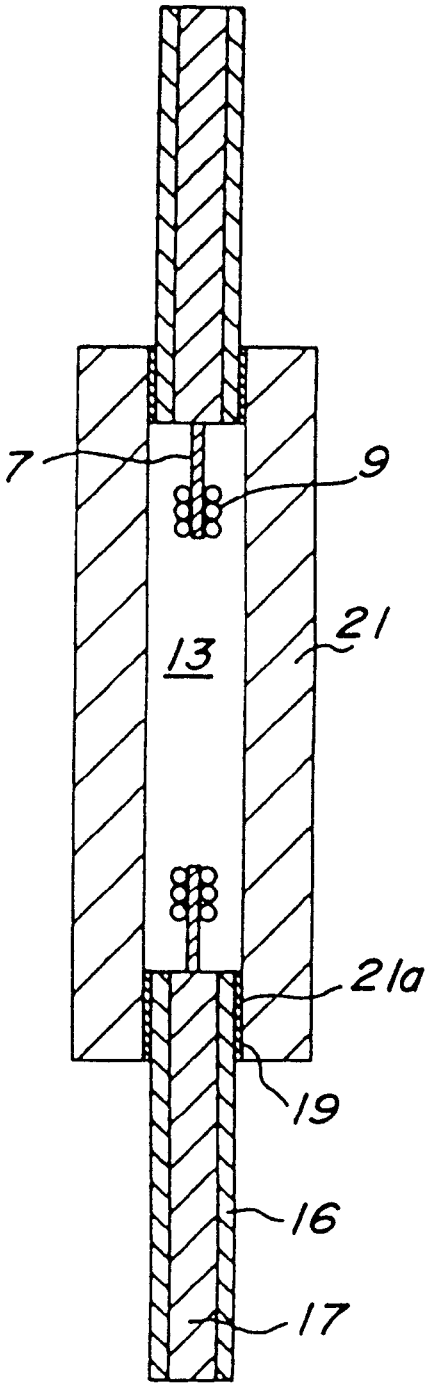
FIGS. 5(*a*) and 5(*b*) are sectional views for schematically showing further high pressure discharge lamps as preferable embodiments of the present invention, respectively.
Figure 5B:
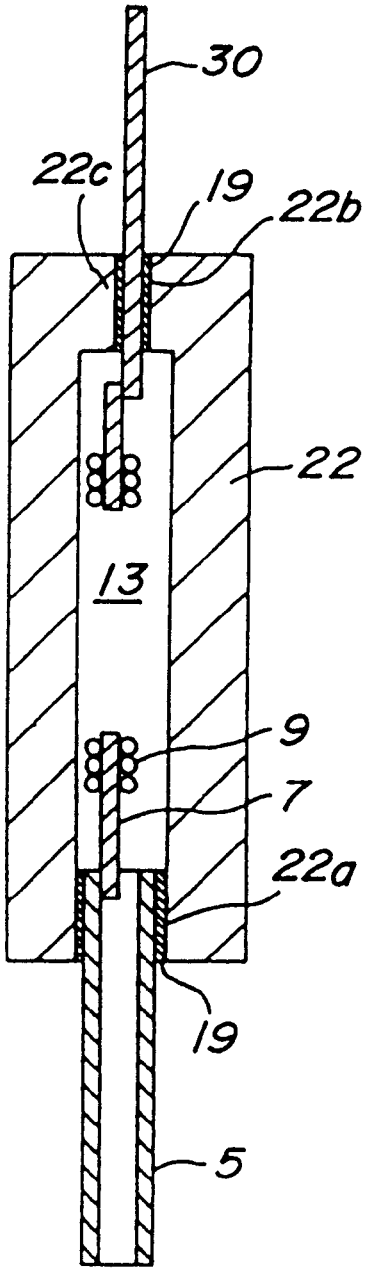

FIGS. 4(*a*) and 4(*b*) and FIGS. 5(*a*) and 5(*b*) are sectional views for schematically showing preferred embodiments of the high pressure discharge lamps according to the present invention. In FIG. 4(*a*), plugging members 14 are fixed to inner sides of respective opposite ends of a straight and tubular ceramic discharge tube 20. Sealing is effected between the tubular member 16 and the inner peripheral face 18*a* of the end portion 18 with a metallizing layer 19.

In FIG. 4(*b*), plugging members are fixed to inner sides of opposite ends of a straight, tubular ceramic discharge tube 20, respectively. In FIG. 4(*b*), sealing is effected between the plugging member 14 and an electrode unit-holding member 5 with a metallizing layer 15 at an upper end portion. In a lower end portion, the plugging member 14A is fixed to the interior of an end portion 20*a*, and a rod-shaped electrode unit-holding member 30 is inserted through a through-hole 14*a* of the plugging member 14A. Sealing is effected between the plugging member 14A and the holding member 30 with the metallizing layer 15.

In FIG. 5(*a*), tubular members 16 are inserted into both end portions of a straight, tubular ceramic discharge tube, respectively, and an electrode unit-holding member 17 is fixed in a through-hole of each of the tubular members 16. Sealing is effected between the tubular member 16 and the end portion of the ceramic discharge tube 21 with a metallizing layer.

In FIG. 5(*b*), a projection 22*c* is provided at an inner side of an upper end portion of a straight, tubular ceramic discharge pipe 22 as viewed in the figure, and a rod-shaped electrode unit-holding member 30 is inserted through the projection 22*c*. Sealing is effected between the inner peripheral face 22*b* of the projection 22*c* and the holding member 30 with a metallizing layer 19. In the lower end portion, a holding member 5 is inserted into an end portion of the ceramic discharge tube, and sealing is effected between the holding member 5 and the inner peripheral face 22*a* of the end portion with a metallizing layer 19.

Figure 6A:
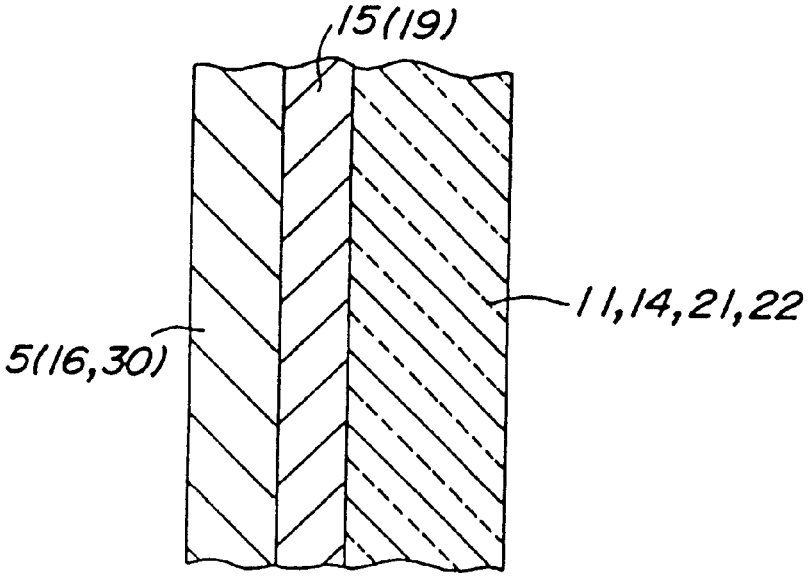
FIG. 6(*a*) is a sectional view for showing a laminated structure of a ceramic discharge tube 11, 21, 22 or a plugging member 14 and a conductive member 5 (16, 30) via a metallizing layer 15 (19), FIG. 6(*b*) being a schematic view of a microstructure in the above sectional view.
Figure 6B:
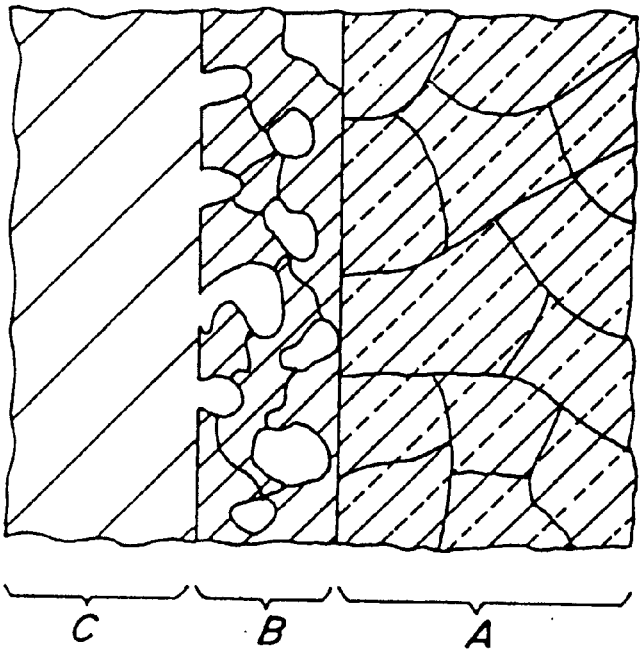

In the above-mentioned embodiments, it is more preferable that the metallizing layer is formed on the conductive member, and simultaneously a fired ceramic layer is provided between the metallized layer and the discharge tube or the plugging member. This will be further explained. FIG. 6(*a*) is a sectional view for showing, in an enlarged scale, a laminated structure between the ceramic discharge tube 11, 21, 22 or the plugging member 14 and the conductive member 5 (16, 30) via the metallizing layer 15 (19). FIG. 6(*b*) schematically shows, in an enlarged scale, a sectional view of a microstructure. C shows a conductive member having a compact and almost dense microstructure. B shows the metallizing layer, and A shows the discharge tube or the plugging member. During a course in which the joining structure is produced, the metallizing layer is firmly joined to the ceramic discharge tube or the plugging member through diffusion of the metal from the metallizing material into the conductive member. On the other hand, since the discharge tube or the plugging member has been firmly press molded and had particles grown with smaller pores, the ceramic component is unlikely to move or diffuse. If the metallic component is diffused from the metallizing material to the discharge tube or the plugging member, an adverse effect is likely to occur.

Figure 7A:
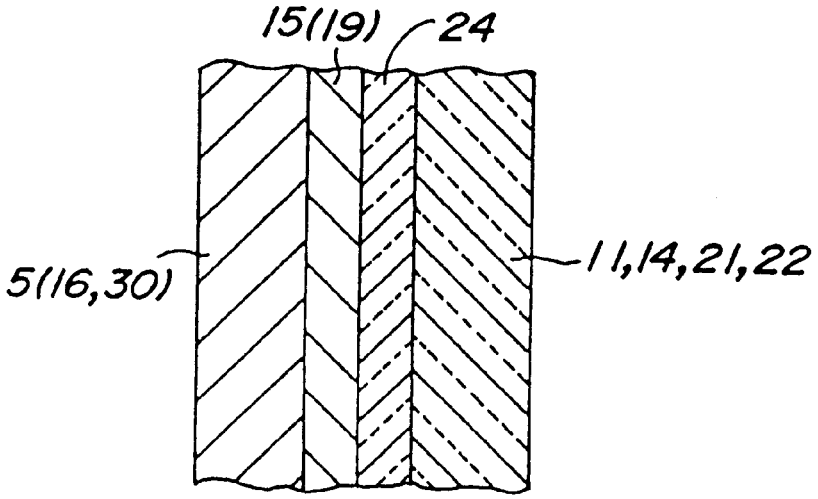
FIG. 7(*a*) is a sectional view for showing a laminated structure of a ceramic discharge tube 11, 21, 22 or a plugging member 14 and a conductive member 5 (16, 30) via a metallizing layer 15 (19), FIG. 7(*b*) being a schematic view of a microstructure in the above sectional view.
Figure 7B:
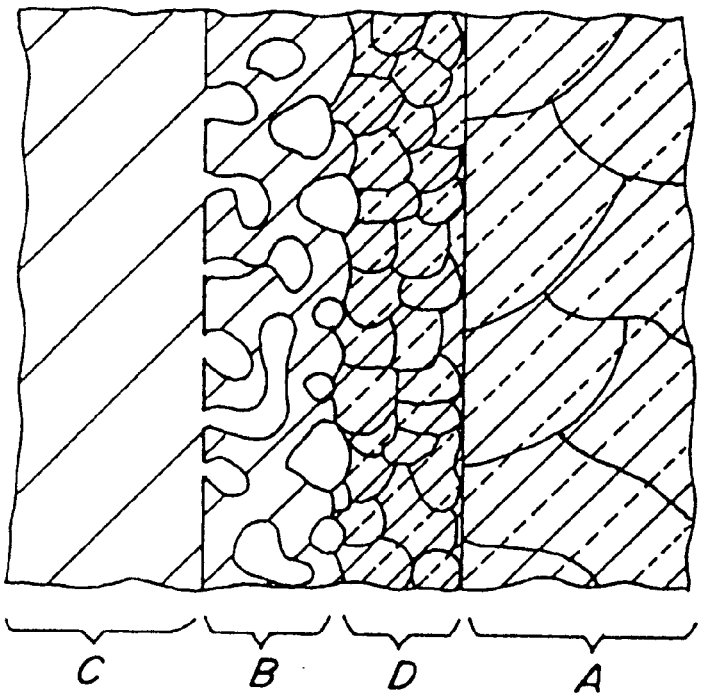

For this reason, it is particularly preferable that as shown in FIG. 7(*a*), a fired ceramic layer 24 is formed between the ceramic discharge tube 11, 21, 22 or the plugging member 14 and the metallizing layer 15 (19). This microstructure is shown in FIG. 7(*b*).

A metallizing layer B is produced adjacent the almost dense microstructure C. D is a fired ceramic layer, and a ceramic component is likely to diffuse between the fired layer and the metallizing layer, whereas the fired layer and the ceramic discharge tube or the plugging member are likely to be firmly joined to each other through diffusion of the ceramic component because their materials are same or similar.

As mentioned above, the ceramic component in the layer of the firing ceramic material is likely to be diffused into the ceramic discharge tube or the plugging member, so that joining force between the ceramic layer and the ceramic discharge tube is further enhanced and stabilized. Further, diffusion of the metallic component from the ceramic metallizing layer 15 (19) to the microstructure of the discharge tube or the plugging tube is reduced.

In order to provide the fired ceramic layer between the plugging member or the ceramic discharge tube and the metallizing layer, a layer of a firing ceramic material is interposed between them. The firing ceramic material is intended to mean a material that produces the intended ceramic material after firing. Specifically, the firing ceramic material includes the above mentioned ceramic component (s).

A layer of the firing ceramic material is preferably formed by any one of the following processes.

(1) A ceramic paste is applied and printed.

(2) A cylindrical molded body made of a ceramic material is inserted and interposed between a non-fired body of the plugging member or a non-fired body of the ceramic discharge tube and a layer of the metallizing material. Since this cylindrical molded body needs to have structural strength sufficient to withstand handling, the cylindrical molded body is preferably produced by press molding.

In order to produce the above cylindrical molded body, a binder is added to the ceramic component. The binder is preferably a binder that is likely to be thermally decomposed and easily pressed. As the binder, polyvinyl alcohol (PVA) and acrylic binder are preferred. The binder and a given amount of a solvent are added to the above ceramic component, and the mixture is granulated by a spray dryer or the like, thereby producing granules. Alternatively, the binder and some solvent are added to the above ceramic component, and the mixture is subjected to kneading, drying and grinding, thereby producing granules. A cylindrical molded body is obtained by press molding the granules under pressure of 2 to 3 tons/cm$^2$.

(a) A sheet-shaped molded body made of a firing ceramic material is interposed between a non-fired body of the plugging member or a non-fired body of the ceramic discharge tube and a layer of the metallizing material.

In order to produce the above sheet-shaped molded body, a binder such as acrylic binder or ethyl cellulose is added to the ceramic component, and the sheet-shaped molded body is obtained from the mixture with use of a solvent such as butylcarbitol acetate, for example, according to the doctor blade process.

Figure 8:
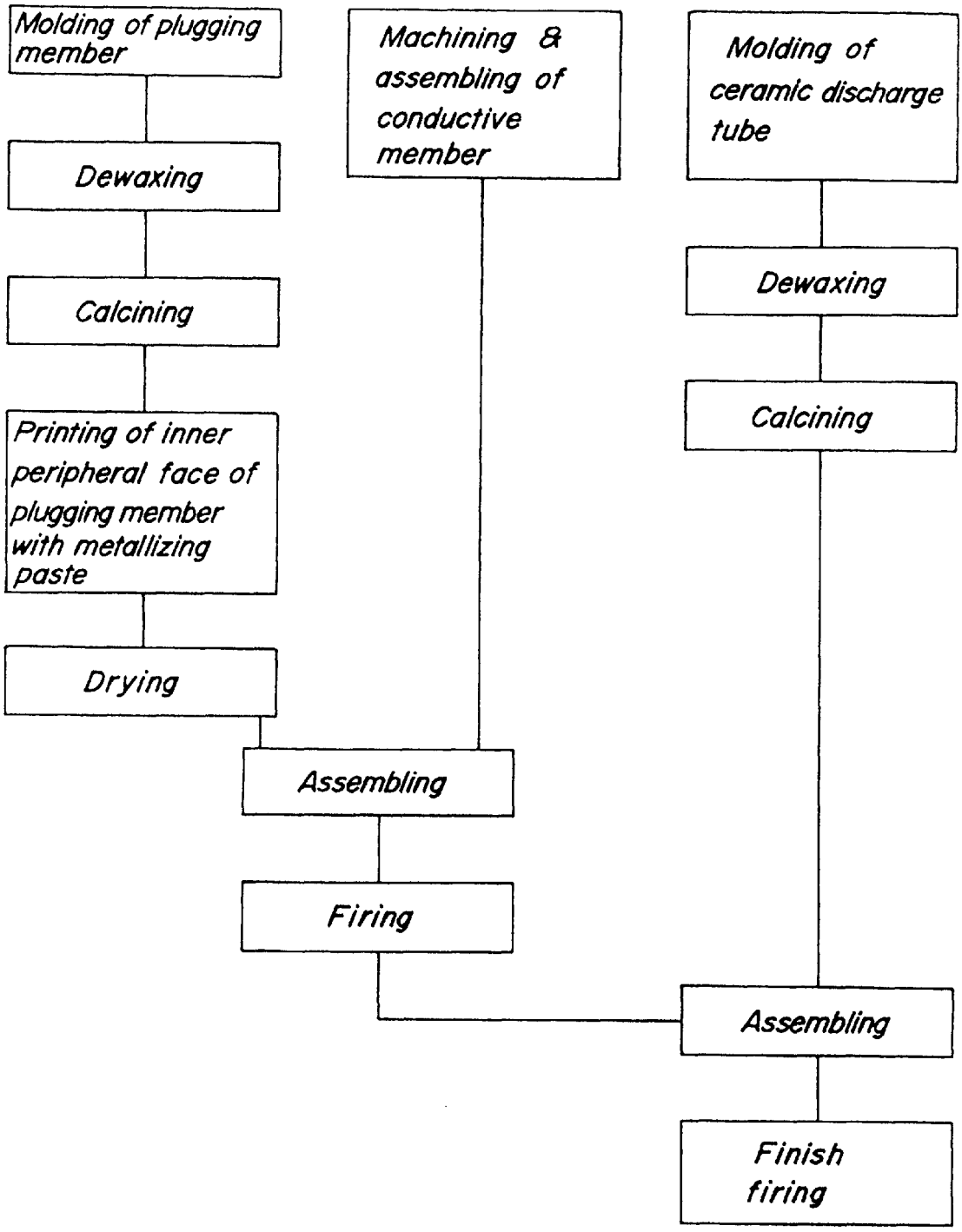
FIG. 8 is a flow chart for illustrating a preferred embodiment of the process for the production of the high pressure discharge lamp according to the present invention.
Figure 9:
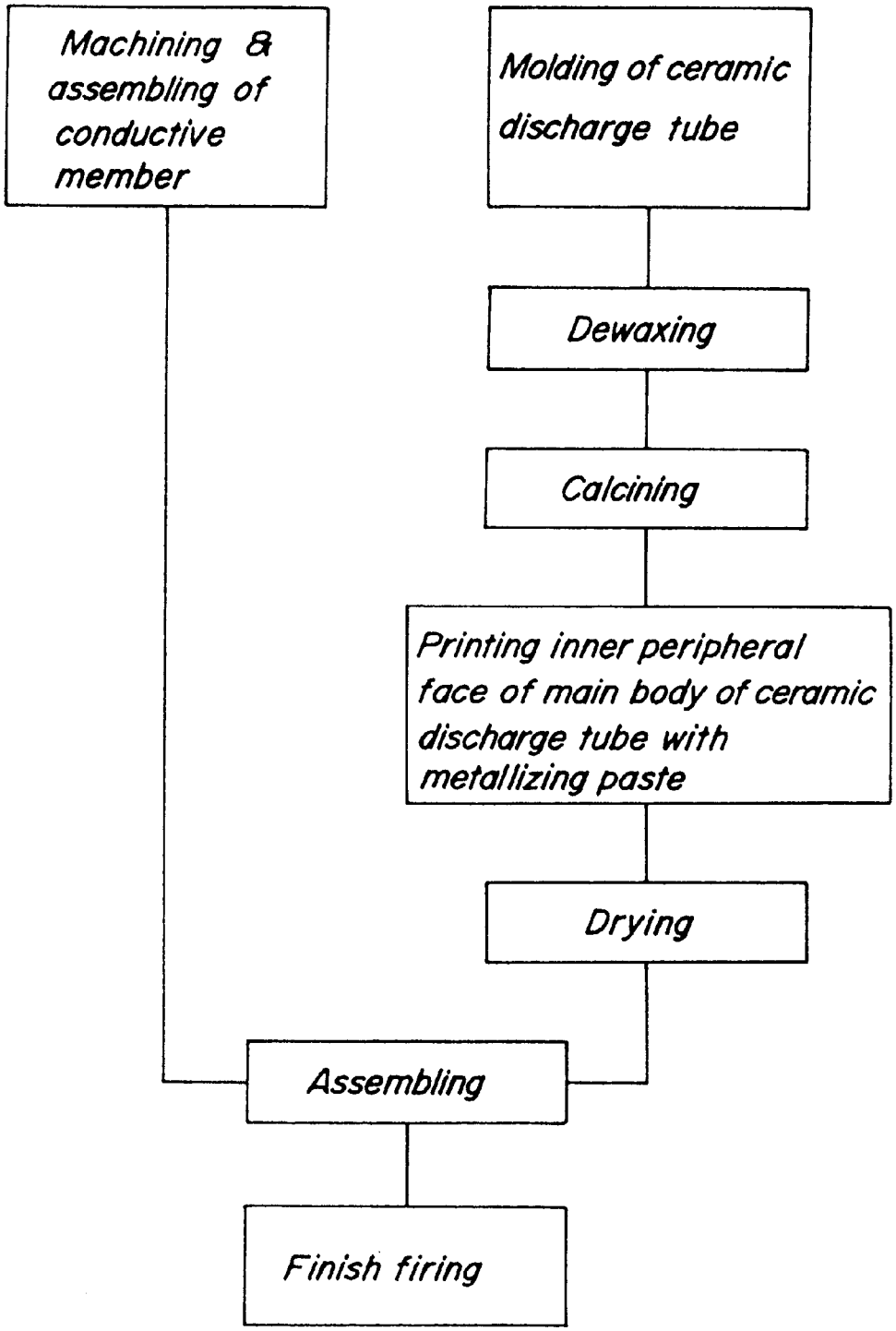
FIG. 9 is a flow chart for illustrating another preferred embodiment of the process for the production of the high pressure discharge lamp according to the present invention.
Figure 10:
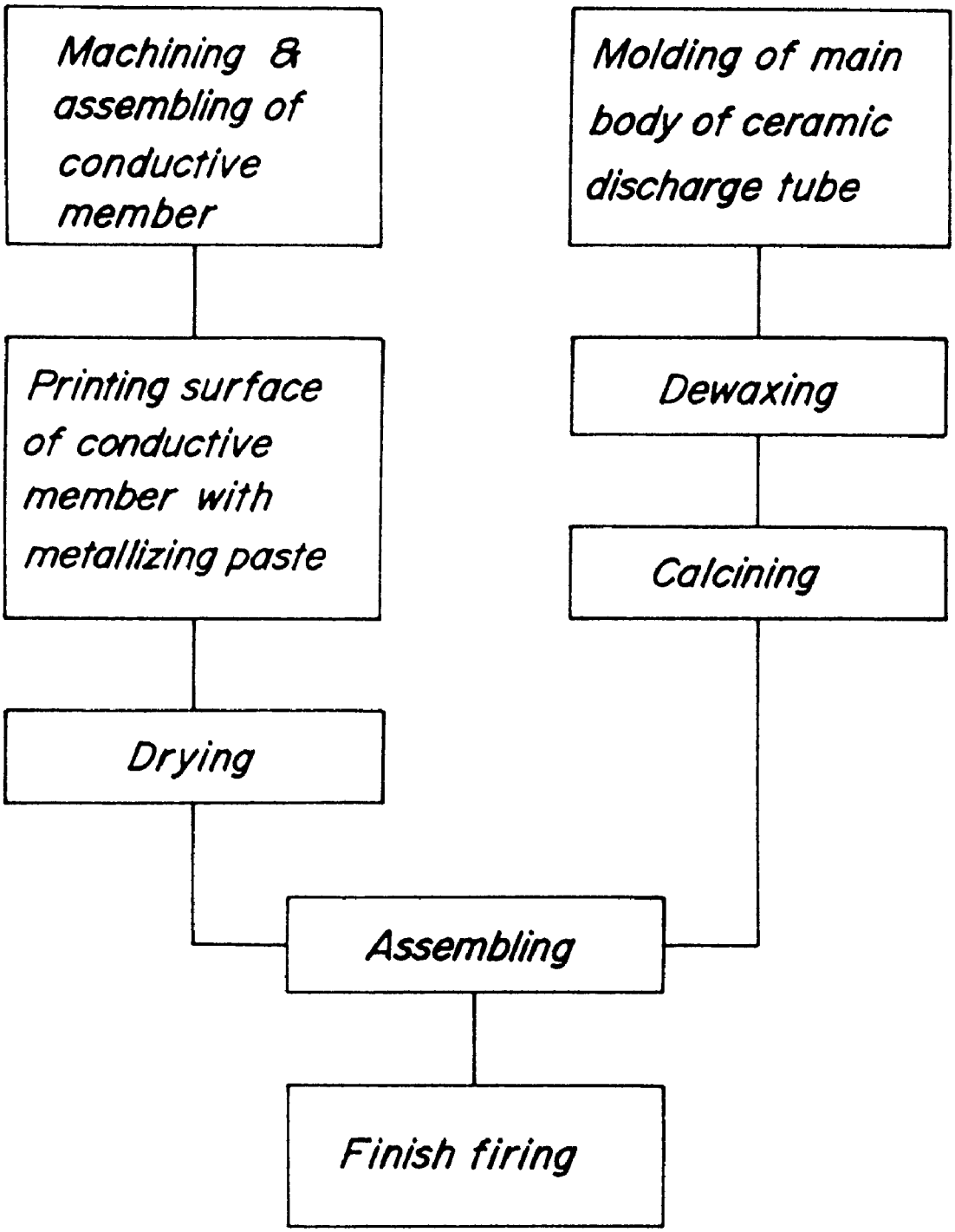
FIG. 10 is a flow chart for illustrating a further preferred embodiment of the process for the production of the high pressure discharge lamp according to the present invention.

Next, preferred embodiments of the processes for the production of the high pressure discharge lamps according to the present invention will be explained. FIGS. 8, 9 and 10 are flow charts for illustrating processes for the production of the high pressure discharge lamps according to the present invention, respectively. A high pressure discharge lamp using plugging members can be produced along with each of the lines shown in FIG. 8. First, molded bodies for ring-shaped plugging members are obtained by molding a powdery material (preferably alumina powder) for the plugging members. At this stage, it is preferable that powder granulated by a spray dryer or the like is press molded under pressure of 2000 to 3000 kgf/cm$^2$. A calcined body is obtained by dewaxing and calcining the thus molded body. Dewaxing is preferably effected under heating at a temperature of 600 to 800° C., and calcining is preferably effected at a temperature of 1200 to 1400° C. in a hydrogen-reducing atmosphere. Some strength is given to the molded body for the plugging member by this calcining, so that the metallizing paste applied can be prevented from being insufficiently leveled through a solvent being sucked off and that handling of the plugging member may be facilitated.

Then, a layer of a metallizing paste is formed on an inner peripheral face of the calcined body for the plugging member by applying the metallizing paste thereon. As the most preferable embodiment, a metallizing paste composed of 60 vol. % of Mo, 40 vol. % of at least one kind of $Al_2O_3$, mullite and metallic silicon, some amount of a binder and a solvent is used. The calcined body is preferably dried at 90 to 120° C. Preferably, the through-hole of the plugging member is printed with the metallizing paste by feeding the metallizing paste to the through-hole of the plugging member from one end via a mask, sucking the paste under vacuum from the other end of the through-hole to suck the metallizing paste into the through-hole, and printing the entire inner face of the through-hole with the metallizing paste.

Next, a conductive member is inserted into the through-hole of the above calcined body (Assembling step) This calcined body is preliminarily fired at a temperature of 1200 to 1600° C. in a reducing atmosphere having a dew point of 20 to 50° C. (Firing step). At a point of time when this preliminary firing is terminated, the conductive member is fixed to the plugging member.

On the other hand, a main body of a ceramic discharge tube is molded, and a calcined body for the ceramic discharge tube is obtained by dewaxing and calcining the molded body. The preliminarily fired body for the plugging member is inserted and set into the end face of the calcined body for the ceramic discharge tube, and the assembly is finish fired at a temperature of 1600 to 1900° C. in a reducing atmosphere having a dew point of −15 to 15° C. Thereby, a high pressure discharge lamp is obtained.

In the process shown in FIG. 8, the metallizing paste may be printed upon the surface of the conductive member without printing the inner peripheral face of the plugging member with the metallizing paste. Alternatively, it may be that a layer of a ceramic paste made of the same material as that of the plugging member is formed on the surface of the plugging member by applying the ceramic paste there, and the metallizing paste is applied to the ceramic paste layer.

In the process shown in FIG. 9, a main body of a ceramic discharge tube is molded, and a calcined body of the ceramic discharge tube is obtained by dewaxing and calcining the molded body. A metallizing paste is applied to the inner peripheral face of the thus calcined body as mentioned above. At that time, a ceramic paste made of the same material as that of the calcined body is applied to the calcined body if necessary before the metallizing paste is applied. The calcined body is dried at 90 to 120° C. in air, and a conductive member is fitted and set in place in a through-hole of the dried body. Then, the resulting assembly is preliminarily fired at 1200 to 1600° C. in a reducing atmosphere having a dew point of 20 to 50° C., and finish fired at a temperature of 1700 to 1900° C. in a reducing atmosphere having a dew point of −15 to 15° C. The above preliminary firing and the above finish firing may be independently effected, but if an atmospheric furnace having a common reducing atmosphere for these firings can be used, the two firings may be continuously effected.

Alternatively, the above calcined body is dewaxed by heating at 300 to 400° C., followed by assembling and finish firing at 1700 to 1900° C. in a reducing atmosphere having a dew point of −15 to 15° C.

A process shown in FIG. 10 may be employed, in which a metallizing paste (including a ceramic paste if necessary) is not applied to a main body of a ceramic discharge body with a ceramic paste in the process of FIG. 9. In the process of FIG. 10, the metallizing paste (including the ceramic paste if necessary) is applied to the surface of the conductive member.

As mentioned above, according to the present invention, the novel sealing structure having high corrosion resistance and high reliability against the metal halide or the like can be offered for the high pressure discharge lamp.

What is claimed is:

1. A process for producing a high pressure discharge lamp comprising a ceramic discharge tube having an inner space filled with an ionizable light-emitting material and a starting gas, plugging members each at least partially fixed to an inner side of respective one of end portions of the ceramic discharge tube and each having a through-hole provided therein, conductive members inserted into or through the through-holes of the plugging members, respectively, and electrode units provided in said inner space, wherein material of the plugging members is the same as that of the ceramic discharge tube, said process comprising the steps of:

inserting the conductive members into or through through-holes of non-fired preforms of the respective plugging members;

providing metallizing layers between the through-holes of the non-fired preforms and the respective conductive members; and then integrally firing the non-fired preforms, the metallizing layers, and the conductive members.

2. The process for producing the high pressure discharge lamp set forth in claim 1, comprising the steps of:

inserting the conductive members into or through the through-holes of the non-fired preforms of the respective plugging members;

providing layers of a firing ceramic material and the layers of the metallizing material between the through-holes of the non-fired preforms and the respective conductive members, the firing ceramic material being contacted with the respective non-fired preforms; and then integrally firing the non-fired preforms, the metallizing material, the firing ceramic paste, and the conductive members.

3. A process for producing a high pressure discharge lamp comprising a ceramic discharge tube having an inner space filled with an ionizable light-emitting material and a starting gas, conductive members inserted into or through through-holes of the ceramic discharge tube at end portions, respectively, and electrode units provided in said inner space, said process comprising the steps of:

inserting the conductive members into through-holes of a non-fired preform of the ceramic discharge tube, respectively;

providing layers of a metallizing material between the through-holes of the non-fired preforms and surfaces of the respective conductive members; and then integrally firing the non-fired preform, the layers of the metallizing paste, and the conductive members.

4. The process for producing a high pressure discharge lamp set forth in claim 3, comprising the steps of:

inserting the conductive members into or through the through-holes of the non-fired preform of the ceramic discharge tube;

providing layers of a firing ceramic material and the layers of the metallizing material between the through-holes of the non-fired preform and the respective conductive members, the firing ceramic material being contacted with the respective non-fired preform; and then integrally firing the non-fired preform, the metallizing material, the firing ceramic material, and the conductive members.

* * * * *